United States Patent [19]

Wright et al.

[11] Patent Number: 4,544,080

[45] Date of Patent: Oct. 1, 1985

[54] CLOSURE HAVING REINFORCED PULL TAB

[75] Inventors: Philip M. Wright, City of Industry; Donald Didier, Chino Hills, both of Calif.

[73] Assignee: General Can Company, Inc., City of Industry, Calif.

[21] Appl. No.: 664,767

[22] Filed: Oct. 25, 1984

[51] Int. Cl.[4] ..... B65D 41/00

[52] U.S. Cl. ..... 220/359; 220/270

[58] Field of Search ..... 220/260, 270, 307, 359; 229/43

[56] References Cited

U.S. PATENT DOCUMENTS

| | | | |
|---|---|---|---|
| 4,087,018 | 5/1978 | Tebbutt | 220/270 |
| 4,253,584 | 3/1981 | Bloeck et al. | 220/359 |
| 4,280,653 | 7/1981 | Elias | 229/43 |
| 4,324,343 | 4/1982 | Moller | 220/359 |
| 4,372,460 | 2/1983 | Brochman et al. | 220/359 |

*Primary Examiner*—George T. Hall

*Attorney, Agent, or Firm*—Barnes, Kisselle, Raisch, Choate, Whittemore & Hulbert

[57] ABSTRACT

A metallic closure for a cylindrical, rectangular or square container comprising a central panel which has a portion thereof adapted for attaching the closure to the end of a container to close the end. The panel has an opening therein and the portion of the metal adjacent the opening is rolled so that the end thereof engages under the inner surface of the panel in a smooth roll such that the free edge is not directly exposed to the contents in the container on which the closure is placed. A composite panel including a layer of plastic is bonded to the central panel and the outer surface of the central panel by heat fusion of plastic. The composite panel includes a tab that is formed integrally thereof and initially is folded back upon itself bringing the surfaces of the tab which bear the plastic into contact so that the two portions of the tab are bonded to one another to provide a double strength tab.

3 Claims, 9 Drawing Figures

15
7
28
16
16
16
16
F
6
5
25
29
29
28
27
27
26
38
31
31
31
30
32
34
33

CLOSURE HAVING REINFORCED PULL TAB

This invention relates to metallic closures for cylindrical, rectangular or square containers.

BACKGROUND AND SUMMARY OF THE INVENTION

A common type of metallic convenience closure comprises a panel with an endless score line forming a central removable portion and a peripheral fixed portion that is attached to the cylindrical container. A pull-tab having a nose portion is fastened to the removable portion by a rivet so that when the pull-tab is manually grasped, the nose portion of the pull-tab moves into position adjacent the score line severing the panel. Further movement of the pull-tab completes the severing to remove the removable portion. Typical patents showing such construction are U.S. Pat. Nos. 3,696,961, 3,819,083 and 3,986,632.

Such closures are effective for the intended purpose but do require various manipulations in the manufacture that increase the cost.

However, they are not 100% safe. If the user of the product in the can moves his hand or finger with a circular motion when in contact with the panel remaining on the can, a cut will occur.

It also has been suggested that a closure be provided which has an opening that is closed by a panel which can be removed or broken as shown, for example, in U.S. Pat. Nos. 3,245,576, 3,274,962, 3,380,662, 3,547,305, 4,253,584 and 3,628,689. A major difficulty with respect to such closures is that the free edge of the metal closure is exposed to the contents and depending upon the contents is a point of incipient corrosion and contamination of the contents.

In the copending patent application Ser. No. 640,134, filed Aug. 13, 1984, there is disclosed and claimed a metallic closure comprising a central panel including means forming a part of the panel for attaching the closure to the end of a container to close the end. The panel has an opening therein and the portion of the metal adjacent the opening is rolled so that the end thereof engages under the inner surface of the panel in a smooth roll such that the free edge is not directly exposed to the contents of the container on which the closure is placed. A composite panel comprising a plurality of layers including a plastic layer is bonded to the central panel on the outer surface of the central panel by heat fusion. One of the problems in the manufacture of such a closure is that the pull-tab which is formed integrally with a composite panel and folded back onto the surface of the composite panel tends to adhere during heat fusion to the apparatus which is folding the tab.

Accordingly, among the objectives of the present invention are to provide a metal closure of the aforementioned type wherein the tab will not adhere to the apparatus and to provide a novel method and apparatus for forming such a closure.

In accordance with the invention, the metallic closure for a cylindrical, rectangular or square container comprises a central panel which has a portion thereof adapted for attaching the closure to the end of a container to close the end. The panel has an opening therein and the portion of the metal adjacent the opening is rolled so that the end thereof engages under the inner surface of the panel in a smooth roll such that the free edge is not directly exposed to the contents in the container on which the closure is placed. A composite panel including a layer of plastic is bonded to the central panel and the outer surface of the central panel by heat fusion of plastic. The composite panel includes a tab that is formed integrally thereof and initially is folded back upon itself bringing the surfaces of the tab which bear the plastic into contact so that the two portions of the tab are bonded to one another to provide a double strength tab.

DESCRIPTION

Figure 1:
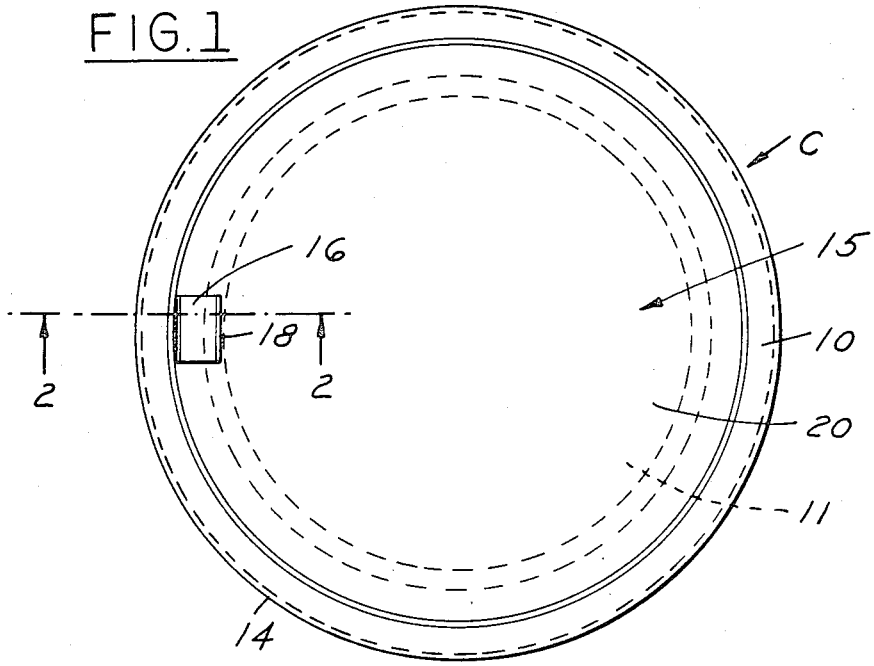
FIG. 1 is a plan view of a closure embodying the invention.
Figure 2:
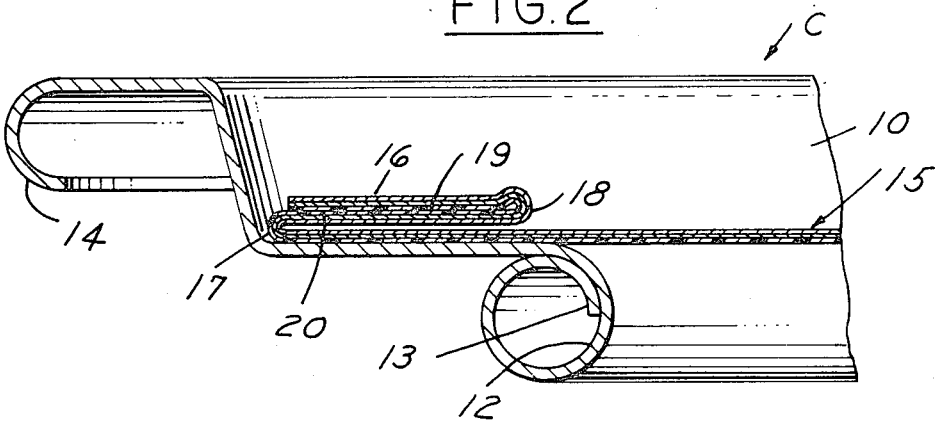
FIG. 2 is a fragmentary sectional view of an enlarged scale taken along the line 2—2 in FIG. 1.
Figure 3:
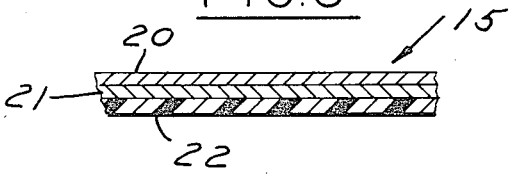
FIG. 3 is a fragmentary sectional view of an enlarged scale of a portion of the composite panel forming part of the closure.

Referring to FIGS. 1–3, the closure C embodying the invention comprises a metallic panel or body 10 which includes a central circular opening 11 formed by cutting away a portion of the panel and rolling the edge 12 of the opening axially and radially so that it faces inwardly with respect to the container when the closure is on the container. More specifically, the periphery of the opening in the panel is formed into a circular bead 12 and the free end 13 engages the inner surface of the metal panel 10 substantially tangentially along the bead 12, so that the edge of the end is not directly exposed to the contents of the container. The closure C includes an annular channel 14 wherein the closure C can be double seamed to the top of a cylindrical container in accordance with well known practice.

A flexible composite panel 15 is bonded to the top or outer surface of the closure to seal the closure. The panel 15 preferably includes a tab 16 that is normally folded along a crease line 17 onto the top surface of the foil panel 15, which tab 16 serves as a means for grasping and removing the panel and providing access to the contents.

In accordance with the invention, the tab 16 is folded intermediate its ends along a crease line 18 and the surfaces 19, 20 are bonded to one another thereby forming a double layer tab.

The metal panel 10 can be made of tinplate blackplate or aluminum that is plain or coated having a thickness on the order of 0.005"–0.010".

The composite panel 15 comprises a flexible base of metal foil or paper, or both, with a thin layer of plastic covering the entire under surface adjacent the metal panel 10 and bonded to the outer surface of the metal panel, preferably by heat sealing through induction of convection. Other materials which can be used are aluminum or paper. Plastics which can be used are polypropylene or polyethylene or ethylene arcylic acid (EAA) and coextrusions of these materials.

In a preferred form, the composite panel comprises paper 20 adhered to a metal foil 21 having a layer of thermo plastic material 22 bonded to the exposed surface of the foil. Thus, the paper is 20 to 50 pound kraft paper adhered by casein to an aluminum foil having a thickness of 0.000285 to 0.002 inch depending on the strength required in the ultimate use. A layer of plastic such as ethylene acrylic acid (EAA) is bonded to the exposed surface of the foil and has a thickness on the order about 0.0002 to 0.004 inch.

When the composite panel and the metallic ring are heated to fuse the plastic to the outer surface of the metallic body 10, the plastic at the surfaces 19, 20 also fuses the portions to one another to form the double layer tab.

Figures 4, 5, 6, 7:
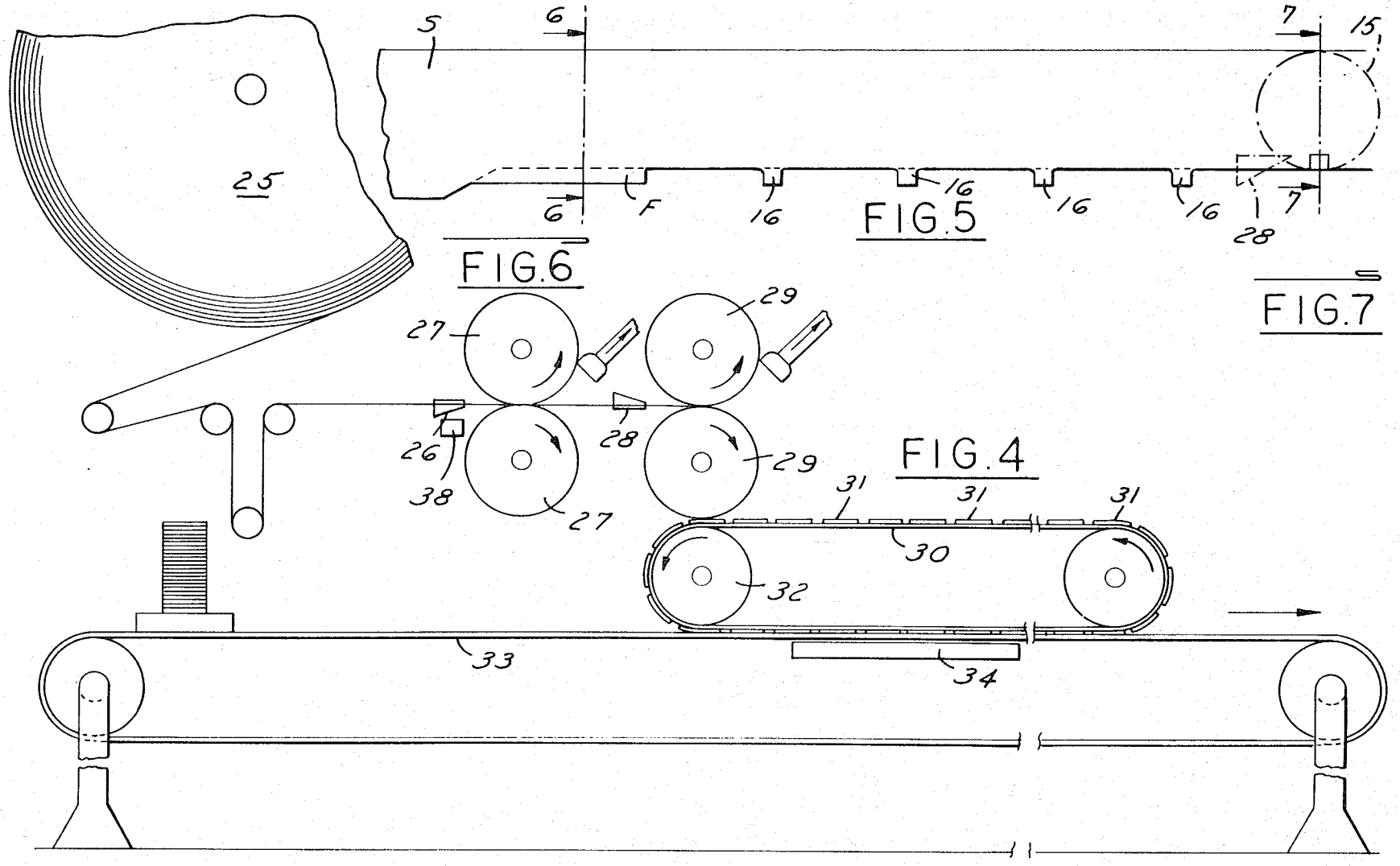
FIG. 4 is a diagrammatic view of the method and apparatus for forming the closure.
FIG. 5 is a diagrammatic plan view showing the formation of the composite panel.
FIG. 6 is a sectional view taken along the line 6—6 in FIG. 5.
FIG. 7 is a sectional view taken along the line 7—7 in FIG. 5.

Referring to FIG. 4, the method and apparatus for forming the closure comprises a roll 25 of strip material from which the composite panel is to be formed. The strip S is fed from the roll 25 through a fold-down device 26 which folds one edge of the strip under the strip to form a folded edge F and thereafter through a pair of cutting rolls 27 that cuts the tabs 16 as shown in FIG. 5. The strip is then moved through a fold-up 28 device that folds the tabs 16 onto the upper surface of the strip and thereafter through another pair of cutting rolls 29 which cut the composite panels 15 from the strip. The panels 15 are then carried by the lower roller 29 to a belt 30 running over vacuum drum 32 in registry with pressure pads 31 and belt 30 that carry the panels 15 around onto the closure bodies 10 that have been fed from a feeder onto an endless belt 33. The pressure pads 31 continue to apply pressure to the panels 15 and respective closure bodies 10 while they move through a heating zone 34 where the plastic on the underside of the composite panels 15 is fused to the periphery of the outer surface of the closure body 10 to form the closure C.

Figure 8:
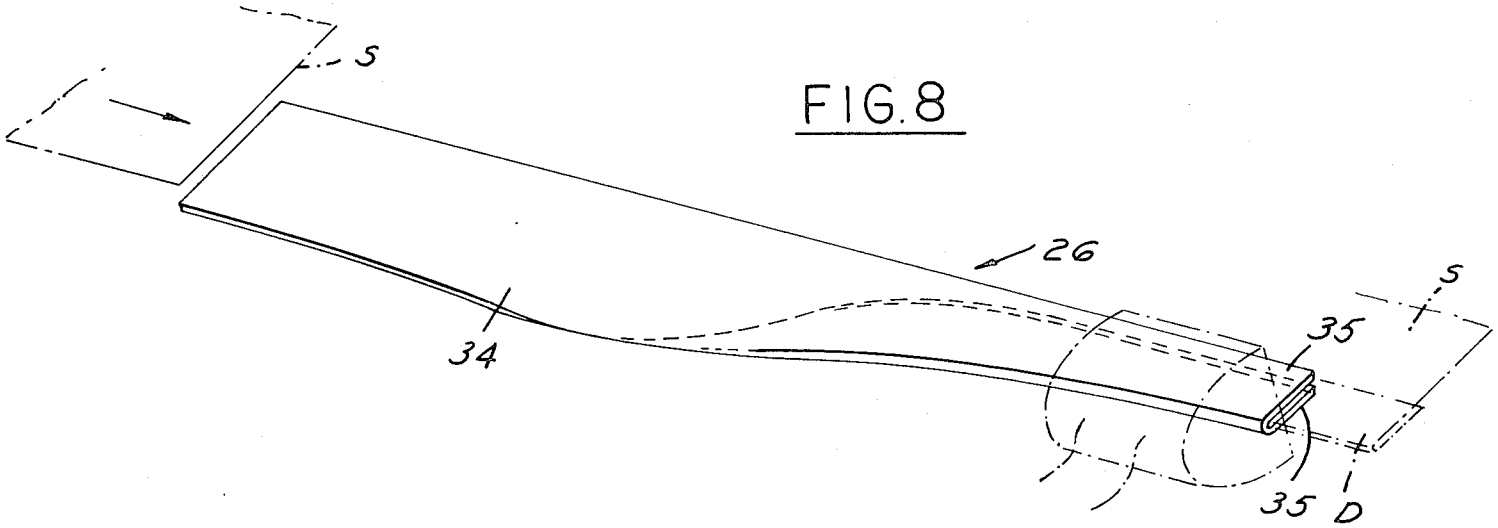
FIG. 8 is a perspective view of a fold-down device utilized in the apparatus.
Figure 9:
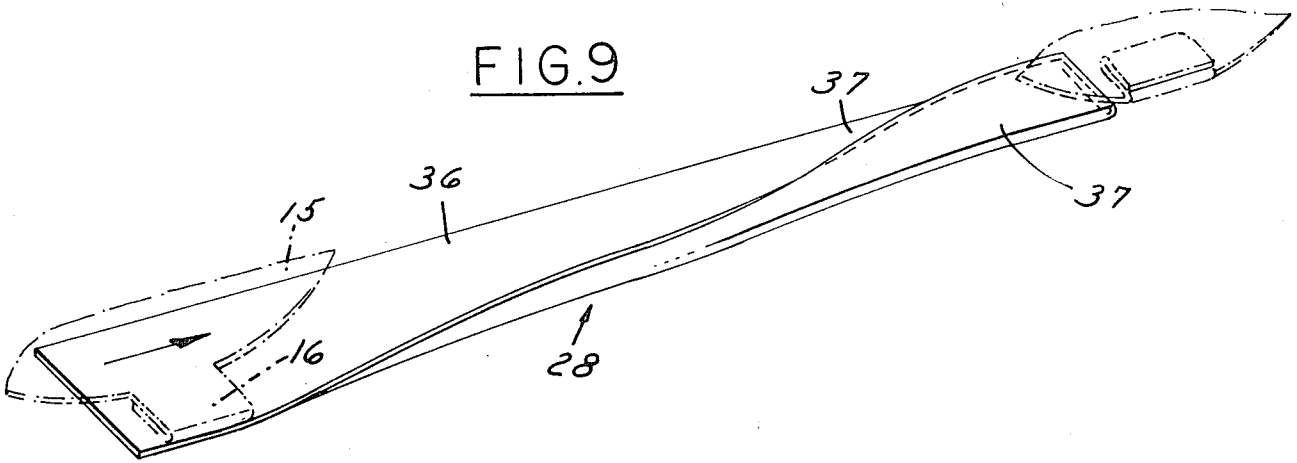
FIG. 9 is a perspective view of a fold-up device utilized in the apparatus.

As shown in FIGS. 8 and 9, the fold-down device 26 comprises a metal member that includes a wall 34 that is progressively curved downwardly to form spaced walls 35 that gradually fold and crease the edge of the strip to form the double layer as at D. The fold-up device 28 is similarly constructed and comprises a wall 36 that gradually tapers upwardly and inwardly to provide spaced walls 37 to fold the tabs onto the outer surface of the composite panel.

As the composite panel is bonded to the closure body, the heat also bonds the two portions of the tab 16 to one another. Since the two portions of the tab 16 that have plastic thereon have been folded onto one another, no portion of the plastic is exposed and therefore there will be no adherence of the tab 16 to the pressure pads 31 or associated apparatus.

Alternatively, a heater 38 can be provided at the fold-down device 26 to bond the two portions of the tab 16 to one another.

We claim:

1. A metallic closure for a container comprising a central panel, means forming a part of the panel for attaching the closure to the end of a container to close the end, said panel having an opening therein, the portion of the metal adjacent the opening being rolled so that the end thereof engages under the inner surface of the panel in a smooth roll such that the free edge is not directly exposed to the contents in the container on which the closure is placed, and a composite panel having a layer of plastic bonded to the central panel on the inner surface of the central panel, said composite panel including an integral radially extending tab for grasping the foil to remove it from the remainder of the closure, said tab comprising a first portion and a second portion having the layer of plastic thereon, said first and second portions being folded over one another with the plastic layers engaging and fusing to form a double layer tab.

2. The closure set forth in claim 1 wherein said tab is normally folded over the outer surface of the composite panel.

3. The closure set forth in claim 1 wherein said composite panel comprises a metal foil on one side of which said plastic layer is formed and a layer of paper on the other side of said metal foil.

* * * * *